US005480065A

United States Patent [19]

Powers

[11] Patent Number: 5,480,065

[45] Date of Patent: Jan. 2, 1996

[54] DEVICE FOR DISPENSING THE CONTENTS OF COLLAPSIBLE TUBE

[76] Inventor: Ronald J. Powers, 550 E. Third St. #B, Oxnard, Calif. 93030

[21] Appl. No.: 398,788

[22] Filed: Mar. 6, 1995

[51] Int. Cl.[6] ..... B65D 35/32

[52] U.S. Cl. ..... 222/99

[58] Field of Search ..... 222/99, 100, 103

[56] References Cited

U.S. PATENT DOCUMENTS

| | | | |
|---|---|---|---|
| 1,497,907 | 6/1924 | Hildebrandt | 222/100 |
| 2,530,476 | 11/1950 | Morris et al. | 222/100 |
| 2,808,963 | 10/1957 | Farrow | 222/100 |
| 2,815,886 | 12/1957 | Chamberlain | 222/99 X |
| 2,896,822 | 7/1959 | Songer | 222/99 |
| 3,088,632 | 5/1963 | Hickey | 222/100 |
| 3,910,460 | 10/1975 | Hausmann et al. | 222/99 |
| 4,576,314 | 3/1986 | Elias et al. | 222/99 X |
| 5,058,771 | 10/1991 | Curtis | 222/99 |
| 5,263,610 | 11/1993 | Okamura et al. | 222/100 |

FOREIGN PATENT DOCUMENTS

| | | | |
|---|---|---|---|
| 846785 | 8/1960 | United Kingdom | 222/99 |

*Primary Examiner*—Kevin P. Shaver
*Attorney, Agent, or Firm*—Edgar W. Averill, Jr.

[57] ABSTRACT

A device for facilitating the dispensing of the contents of a collapsible tube. The device has a turn key member which is supported in a frame. The frame has a tube contact face which is preferably curved. The turn key has a handle. To dispense of the contents of a tube, the bottom of the tube is placed in a slot in the turn key member and the tube rests against the face of a tube support member. As the turn key is turned the tube winds around the turn key and the portion of the tube that winds around the turn key is exposed to the user's touch.

6 Claims, 2 Drawing Sheets

DEVICE FOR DISPENSING THE CONTENTS OF COLLAPSIBLE TUBE

BACKGROUND OF THE INVENTION

The field of the invention is housewares and the invention relates more particularly to a device for facilitating the dispensing of toothpaste (or other material) from a tube.

Numerous devices have been devised for this purpose with varying degrees of success. The Songer U.S. Pat. No. 2,896,822 shows a collapsible tube roller which has a turn key rotatingly held within a generally U-shaped cavity. As the handle is turned the tube is squeezed between one of the guide lips of the cavity. The Hausmann, et al. device of U.S. Pat. No. 3,910,460 also has a slotted turn key in a cavity and has a number of ribs which help squeeze the contents of the tube out of the tube as the turn key is turned. The Elias, et al. U.S. Pat. No. 4,576,314 also has a slotted turn key which is held within a body which has a pair of jaws which help to squeeze the contents out of the tube as the turn key is turned.

Because these devices support the turn key in a cavity, they are limited as to the size of tube with which they can be used.

SUMMARY THE INVENTION

It is an object of the present invention to provide an easy-to-use device to assist in the dispensing of the contents of a collapsible tube which is capable of being used effectively on various sizes of tubes.

The present invention is for a device for dispensing the contents of a collapsible tube. The device has a turn key and tube support member which has a bearing support plate with a bearing supported thereby. The bearing is positioned so that the turn key held thereby is in a horizontal position when the device is positioned as described in the claim. The bearing support plate has a turn key face and a handle face. The bearing support plate extends upwardly from the bearing to a tube support plate which extends in a direction generally parallel to the central axis of the bearing outwardly from the turn key face of the bearing support plate. The tube support plate has a tube contact face, an upper edge, a lower edge and a back face. An exposed turn key is rotatingly held by the bearing support plate in the bearing thereof. The turn key has a hollow slotted arm extending outwardly from the turn key face of the bearing support plate. The turn key has a handle extending outwardly from said turn key in a direction away from the handle face of the bearing support plate. The slotted arm includes a tube base supporting slot and the slotted arm is exposed to a user's touch when the slotted arm is supported in the bearing. When a tube is wrapped around the slotted arm, the exterior portion of the tube, which is wrapped around the hollow slotted arm, is exposed to the user's touch. Preferably, the tube contact face is curved to assist in positioning a tube during use of the device.

DESCRIPTION OF THE PREFERRED EMBODIMENTS

Figure 1:
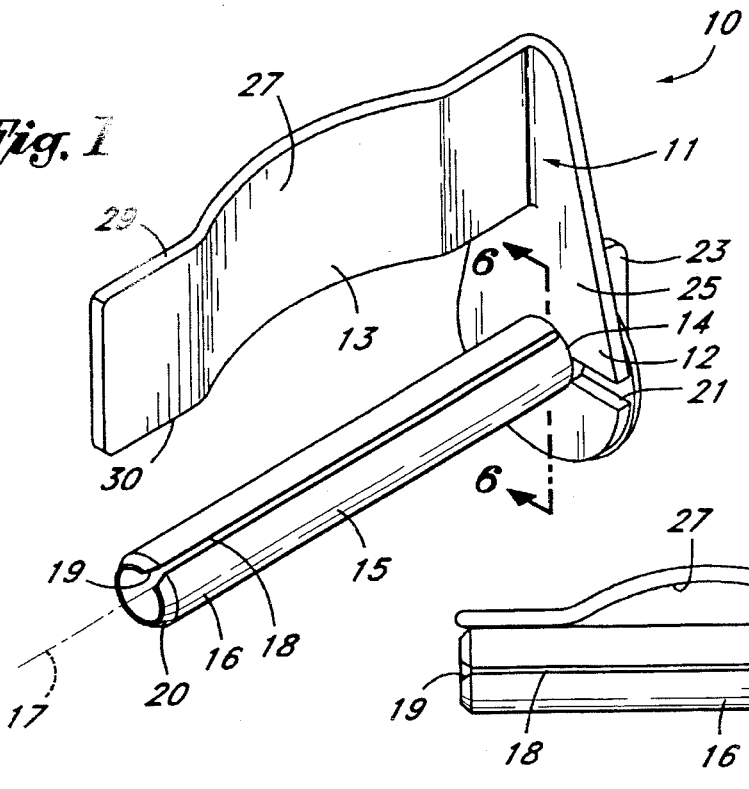
FIG. 1 is a perspective view of the device for dispensing the contents of a collapsible tube of the present invention.

The device for facilitating the dispensing of the contents of a tube is shown in perspective view in FIG. 1 and indicated generally by reference character 10. Device 10 has turn key and tube support member 11 which has a bearing support plate 12 and a tube support plate 13. Bearing supporting plate 12 has a bearing 14 which supports a turn key 15 which has a hollow slotted arm 16 which turns about its horizontal central axis 17. While the term "horizontal" is used herein, it, of course, refers to the device only as positioned in FIG. 1. It permits the description of the position of features such as vertical, above, below and the like. It is, of course, understood that the device will operate in any orientation. Hollow slotted arm 16 has a tube base supporting slot 18 which has a curved entry way 19 to facilitate sliding a tube therein. This arm 16 is also beveled at 20 to assist in inserting turn key 15 into bearing 14.

Figure 6:
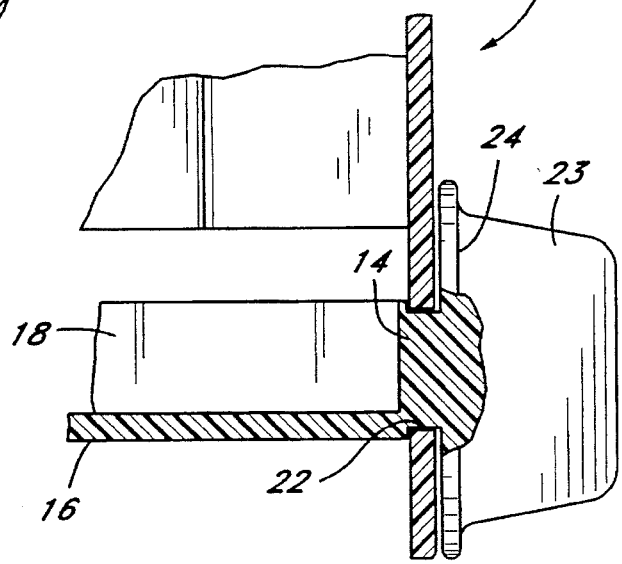
FIG. 6 is a cross-sectional view taken along line 6—6 of FIG. 1.

It should be noted that bearing 14 exerts a continual resistance against turning of the turn key by the provision of an elastic opening at the base of slot 21. Thus, as shown in FIG. 6, bearing 14 presses against the bearing surface 22 of turn key 15 so that the turn key resists unwinding in use. Turn key 15 has a handle 23 and a handle disk 24 which eliminates any rubbing of the user's finger against the bearing support plate 12 during use.

Figure 2:
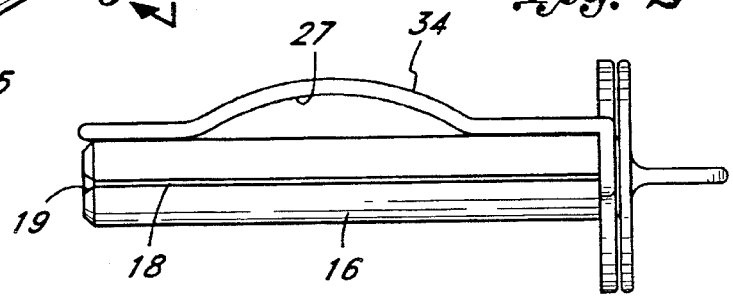
FIG. 2 is a top view thereof.
Figure 3:
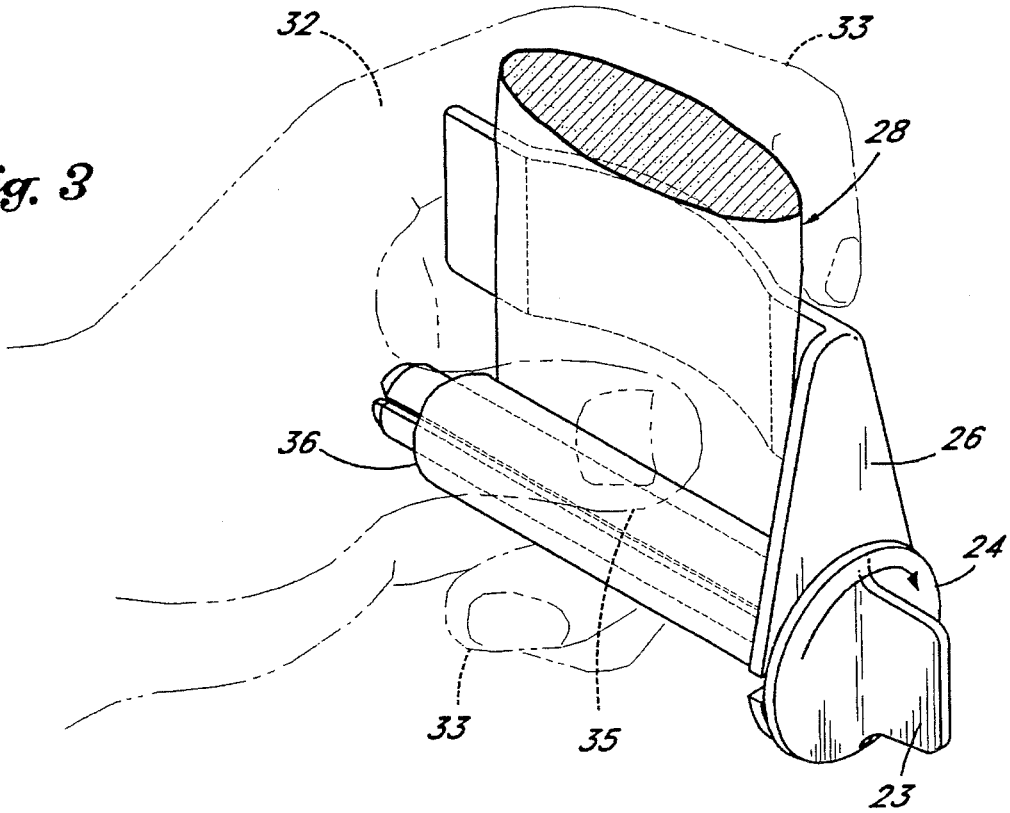
FIG. 3 is a perspective view thereof with a tube held thereby and showing a user's hand in phantom view.

Bearing support plate 12 has a turn key face 25 and a handle face 26 shown best in FIG. 3. Tube support plate 13 extends at roughly a right angle from turn key and tube support member 11. Tube support plate 13 has a tube contact face 27 which is preferably curved as shown best in FIGS. 1 and 2. This curved face helps to support a collapsible tube such as collapsible tube 28 of FIG. 3. Tube support plate 13 has an upper edge 29 and a lower edge 30 which is preferably above hollow slotted arm 16 as shown best in FIG. 4 of the drawings.

Figure 4:
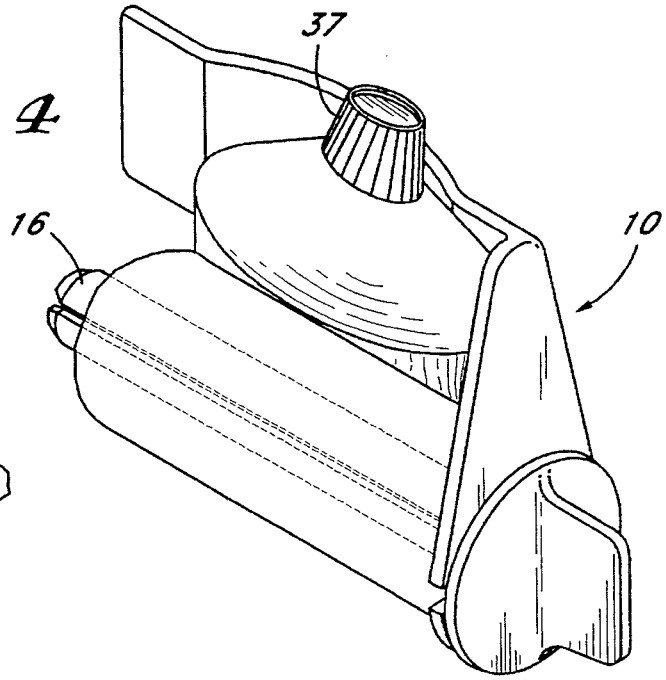
FIG. 4 is a front view showing a tube essentially completely dispensed.
Figure 5:
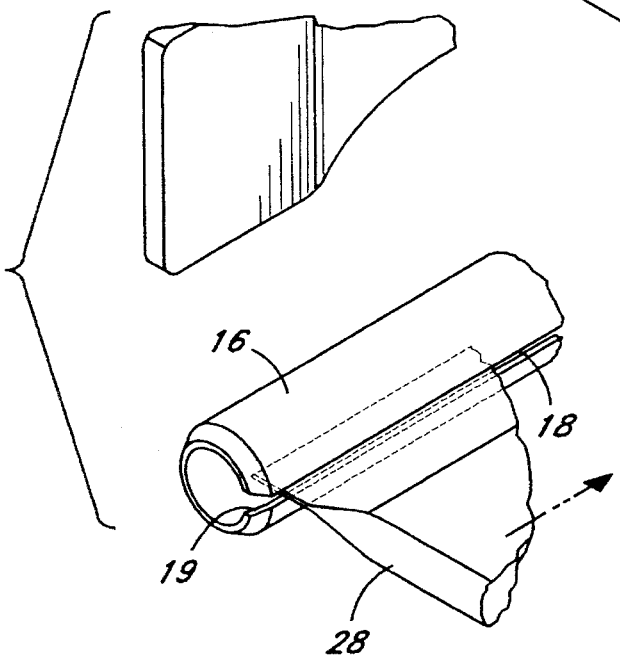
FIG. 5 is a perspective view showing a tube after it has been inserted in the turn key of the device of FIG. 1.

In use, the base 31 (shown in FIG. 5) of collapsible tube 28 is pushed into tube base supporting slot 18. This can be easily done as is evident from reviewing FIGS. 1, 2 and 5 since hollow slotted arm 16 is exposed and may easily be grasped by the user to start the insertion. Once the base 31 has been fully inserted, the user grasps the device as shown best in FIG. 3. The user's hand 32 is shown in phantom view in FIG. 3. The user's fingers 33 are allowed to rest on the back face 34 of tube support plate 13. The user's thumb 35 rests upon that portion of collapsible tube 28 which has been wound around turn key 15 and which part is indicated by reference character 36. The handle 23 is then turned. The contents are then dispensed as desired until the tube has reached a fully dispensed position as shown in FIG. 4. It can be seen that the cap 37 can still be removed and the last of the contents used as is evident in FIG. 4.

An important feature of the present invention is the positioning of the tube support plate 13 above the central axis 17 of turn key 15. In this way the device is easily turned because the turning action can be easily resisted by the user's hand. If the tube support plate was very close to the handle as, for instance, shown in the Songer U.S. Pat. No. 2,896,822, such turning would be much more difficult. Another important feature of applicant's device is the exposed portion of the turned tube 36 wherein the user can easily squeeze even the smallest amount of material out of the tube as it is turned by pressing his thumb 35 and fingers 33 against the turned part of the tube.

The device of the present invention can be easily fabricated by injection molding from two pieces and also easily assembled. It is intuitive to use and the curved tube contact face 27 greatly assists in positioning the tube during use. The device never needs to be disassembled during use since it can be readily unwound after the contents are completely dispensed and removed for insertion of a new tube.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A device for dispensing the contents of a collapsible tube comprising:

a turn key and tube support member having a bearing support plate with a bearing supported thereby, said bearing having a horizontal central axis, said bearing support plate having a turn key face and a handle face, said bearing support plate extending upwardly from said bearing to a tube support plate which extends generally parallel to said central axis of said bearing outwardly from said turn key face of said bearing support plate, said tube support plate having a tube contact face, an upper edge, a lower edge and a back face and wherein the lower edge of said tube contact face is above said slotted arm when said tube contact face is vertical and the upper edge of said tube support plate is above the slotted arm and wherein said tube contact face is curved to partially surround a tube placed in the device; and an exposed turn key rotatingly held by said bearing support plate in the bearing therein about the central axis of the bearing, said turn key having a hollow, slotted arm extending outwardly from said turn key face of said bearing support plate, said turn key having a handle extending outwardly from said turn key in a direction away from the handle face of said beating support plate, said slotted arm including a tube base supporting slot and said slotted arm being exposed to a user's touch when the slotted arm is supported in the bearing and when a tube is wrapped around the slotted arm, an exterior of a portion of the tube, which is wrapped around the hollow slotted arm, is exposed to a user's touch, whereby when a tube base is inserted into said tube base supporting slot and the handle turned and the back face of the tube support plate is held to resist the turning of the handle, the tube is rolled around the turn key and the tube rests against the tube contact face and any contents of the tube are forced out of the top thereof.

2. The device of claim 1 wherein said bearing is a friction bearing to help prevent the slotted arm from unwinding in use.

3. The device of claim 2 wherein said bearing has a slot extending to an exterior edge of said bearing support plate.

4. A device for dispensing the contents of a collapsible tube comprising:

a support member having a bearing support portion and a tube support portion, said bearing support portion being at a right angle to said tube support portion, said tube support portion having a vertical tube contact face and said bearing support portion having a bearing positioned to support a hollow slotted arm in a horizontal position below a lower edge of said tube support portion, said support member being free of any other tube support member; and a slotted arm member supported in a horizontal manner solely by said bearing in a cantilevered manner and said slotted arm member having a slotted arm positioned below said tube support portion and said slotted arm member having a handle extending outwardly from said slotted arm member outwardly of said bearing support portion and said bearing and said slotted arm member having means for exerting resistance against the turning of said slotted arm member in said bearing.

5. The device of claim 4 wherein said tube support portion is curved at said tube contact face.

6. The device of claim 4 wherein said means for exerting resistance against the turning of said slotted arm member in said bearing is an expanded C-shaped bearing which exerts pressure against said slotted arm member.

* * * * *